US008720054B2

(12) United States Patent
Kobayashi

(10) Patent No.: US 8,720,054 B2
(45) Date of Patent: May 13, 2014

(54) METHOD OF SETTING PERFORMANCE CHARACTERISTIC OF PUMP AND METHOD OF MANUFACTURING DIFFUSER VANE

(75) Inventor: Kazuta Kobayashi, Hyogo-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 368 days.

(21) Appl. No.: 12/739,447

(22) PCT Filed: Jan. 13, 2009

(86) PCT No.: PCT/JP2009/050301

§ 371 (c)(1),
(2), (4) Date: Apr. 23, 2010

(87) PCT Pub. No.: WO2009/090934

PCT Pub. Date: Jul. 23, 2009

(65) Prior Publication Data

US 2011/0209346 A1 Sep. 1, 2011

(30) Foreign Application Priority Data

Jan. 18, 2008 (JP) ..... 2008-009062

(51) Int. Cl.

| | |
|---|---|
| ***F04D 29/24*** | (2006.01) |
| ***F04D 29/30*** | (2006.01) |
| ***F04D 29/46*** | (2006.01) |
| ***F04D 29/56*** | (2006.01) |

(52) U.S. Cl.

USPC ..... 29/888.025; 29/888.02; 417/53; 417/423.1

(58) Field of Classification Search

USPC ..... 29/888.02, 888.025; 417/53, 423.1, 417/423.14

See application file for complete search history.

(56) References Cited

U.S. PATENT DOCUMENTS 2,959,116 A * 11/1960 O'Day et al. ..... 454/309
3,101,690 A * 8/1963 O'Day et al. ..... 72/325

(Continued)

FOREIGN PATENT DOCUMENTS

JP 6213189 A 8/1994
JP 9228976 A 9/1997

(Continued)

OTHER PUBLICATIONS

ISR for PCT/JP2009/050301 mailed Feb. 10, 2009.

(Continued)

*Primary Examiner* — Peter Dungba Vo
*Assistant Examiner* — Kaying Kue
(74) *Attorney, Agent, or Firm* — Lowe Hauptman & Ham, LLP

(57) ABSTRACT

To provide a method of setting a performance characteristic of a pump for setting a performance characteristic of a pump, the pump including an impeller that takes in fluid from a suction port and that sends out the fluid toward a discharge port, and a diffuser provided in a flow passage between the impeller and the discharge port, where the diffuser includes a hub arranged in a central portion of the flow passage, a shroud arranged around a periphery of the hub, and a plurality of diffuser vanes radially arranged from an outer peripheral surface of the hub toward an inner peripheral surface of the shroud, and the method includes a mounting-position setting step of setting a mounting position of each of the diffuser vanes to be mounted on the hub according to the performance characteristic of the pump in a direction perpendicular to a radial direction extending from the hub toward the shroud.

3 Claims, 4 Drawing Sheets

(56) References Cited

U.S. PATENT DOCUMENTS

| | | | | | |
|---|---|---|---|---|---|
| 3,217,628 | A | * | 11/1965 | Sweeney et al. | 454/310 |
| 3,243,159 | A | * | 3/1966 | Hefler et al. | 415/156 |
| 4,288,198 | A | * | 9/1981 | Hibino et al. | 415/1 |
| 5,636,440 | A | | 6/1997 | Bichon et al. | |
| 5,683,223 | A | * | 11/1997 | Harada et al. | 415/17 |
| 5,947,680 | A | * | 9/1999 | Harada et al. | 415/17 |
| 6,193,470 | B1 | * | 2/2001 | Aurbeck | 417/53 |
| 6,238,186 | B1 | | 5/2001 | Sato et al. | |
| 6,581,399 | B2 | * | 6/2003 | Benedict et al. | 62/228.1 |
| 6,702,555 | B2 | * | 3/2004 | Allen et al. | 417/423.1 |
| 2001/0033792 | A1 | * | 10/2001 | Nagaoka et al. | 415/208.3 |
| 2002/0184905 | A1 | * | 12/2002 | Benedict et al. | 62/228.4 |
| 2003/0185676 | A1 | * | 10/2003 | James et al. | 415/199.2 |
| 2004/0013547 | A1 | * | 1/2004 | Allen et al. | 417/423.1 |
| 2006/0275114 | A1 | * | 12/2006 | Mangnall et al. | 415/206 |

FOREIGN PATENT DOCUMENTS

| | | | |
|---|---|---|---|
| JP | 11082390 | A | 3/1999 |
| JP | 2001107897 | A | 4/2001 |
| JP | 2001-355592 | A | 12/2001 |
| JP | 3305927 | B2 | 7/2002 |
| JP | 2003343493 | A | 12/2003 |
| JP | 3935278 | B2 | 6/2007 |
| KR | 1997-0001984 | A | 1/1997 |
| KR | 2001-0042969 | A | 5/2001 |
| KR | 10-2004-0015051 | A | 2/2004 |

OTHER PUBLICATIONS

Notice of Allowance issued in Korean Application No. 10-2010-7009532 dated Mar. 12, 2013. (w/Partial English translation).

Decision of a Patent Grant issued in corresponding Japanese patent application No. 2008009062 issued May 21, 2013.

* cited by examiner (1) BASIC MOUNTING POSITION (2) X DIRECTION +100 (3) X DIRECTION +200
(4) X DIRECTION +250 (5) X DIRECTION +300

METHOD OF SETTING PERFORMANCE CHARACTERISTIC OF PUMP AND METHOD OF MANUFACTURING DIFFUSER VANE

RELATED APPLICATIONS

The present application is national phase of International Application No. PCT/JP2009/050301, filed Jan. 13, 2009 and claims priority from, Japanese Application Number 2008-009062, filed Jan. 18, 2008, the disclosures of which are hereby incorporated by reference herein in their entirety.

TECHNICAL FIELD

The present invention relates to a method of setting a performance characteristic of a pump for setting a performance characteristic of a pump having a diffuser, and relates to a method of manufacturing a diffuser vane.

BACKGROUND ART

A mixed-flow pump and an axial-flow pump have been known as conventional pumps. Each of the mixed-flow pump and the axial-flow pump includes an impeller that sends out fluid in a rotation-axial direction, and a diffuser provided downstream of the impeller (see, for example, Patent Document 1).

As the mixed-flow pump, a type of pump having an appropriate performance characteristic suitable for an installation environment is used so that the mixed-flow pump can be efficiently operated according to its installing location or the use for the pump. In this case, if an inlet angle of each of diffuser vanes provided in the diffuser is set to a desired inlet angle, the performance characteristic of the mixed-flow pump can be set to a desired performance characteristic. At this time, the performance characteristic of the mixed-flow pump can be set by changing a bending curvature of each of the diffuser vanes and setting the inlet angle of the diffuser vanes. However, because the bending curvature of the diffuser vane is largely changed, the optimal shape thereof is changed, and there is a concern that a performance of the mixed-flow pump can be deteriorated. To suppress the deterioration in performance of the mixed-flow pump, it is necessary to newly design the shape of the diffuser vane according to a set inlet angle of the diffuser vane. That is, when a desired performance characteristic of the mixed-flow pump is set, it is necessary to newly design each of the diffuser vanes.

Patent Document 1: Japanese Patent Application Laid-open No. 2001-355592

DISCLOSURE OF INVENTION

Problem to be Solved by the Invention

If diffuser vanes are newly designed according to a desired performance characteristic of the mixed-flow pump, it is necessary to again design the diffuser vanes from the beginning, and it takes a tremendous burden. Therefore, there is a concern that it becomes difficult to shorten a manufacturing period of the mixed-flow pump.

It is therefore an object of the present invention to provide a method of setting a performance characteristic of a pump capable of setting a performance characteristic of the pump with a simple method, while suppressing deterioration in performance of the pump, and a method of manufacturing a diffuser vane.

Means for Solving Problem

According to an aspect of the present invention, a method of setting a performance characteristic of a pump, which includes an impeller that takes in fluid from a suction port and that sends out the fluid toward a discharge port, and a diffuser provided in a flow passage between the impeller and the discharge port, includes: providing the diffuser with a hub arranged in a central portion of the flow passage, a shroud arranged around a periphery of the hub, and a plurality of diffuser vanes radially arranged from an outer peripheral surface of the hub toward an inner peripheral surface of the shroud, and setting a mounting position of each of the diffuser vanes to be mounted on the hub according to a performance characteristic of the pump in a direction perpendicular to a radial direction extending from the hub toward the shroud.

Advantageously, in the method of setting a performance characteristic of a pump, in a basic design of the pump, each of the diffuser vanes is mounted on the hub at a reference mounting position as a reference, and in setting a mounting position, the mounting position is set by changing a position of the diffuser vane from the basic mounting position by an offset amount set according to a performance characteristic of the pump.

According to another aspect of the present invention, a method of manufacturing a diffuser vane includes: die-cutting a sheet metal member that is a material of the diffuser vane from a metal plate, based on the mounting position set in the method of setting a performance characteristic of a pump set forth above, and bending the die-cut sheet metal member to form the diffuser vane.

Effect of the Invention

According to a method of setting a performance characteristic of a pump of claim 1, it is possible to easily set a performance characteristic of a pump by setting a mounting position of a diffuser vane to an arbitrary mounting position according to performance of the pump in a perpendicular direction. More specifically, if the mounting position of the diffuser vane in the perpendicular direction is set, an inlet angle of the diffuser vane is set according to the former setting. If the inlet angle of the diffuser vane is set, the performance characteristic of the pump is set. At this time, a bending curvature of the diffuser vane is not changed. Therefore, deterioration in the performance of the pump that is caused by a shape change of the diffuser vane can be suppressed. With this configuration, it is unnecessary to newly design the diffuser vane according to the setting of the performance characteristic of the pump, and it is possible to set the performance characteristic of the pump by a simple method, that is, by setting the mounting position of the diffuser vane in the perpendicular direction.

According to a method of setting a performance characteristic of a pump of claim 2, it is only necessary to change the mounting position of the diffuser vane from a basic mounting position as an index by an offset amount set according to a performance characteristic of the pump. Therefore, it is possible to easily change the mounting position.

According to a method of manufacturing a diffuser vane of claim 3, it is possible to die-cut a sheet metal member according to a diffuser vane that is mounted on a set mounting position. Therefore, it is possible to manufacture the diffuser vane that is suitable for the mounting position by bending the die-cut sheet metal member. According to the method of manufacturing the diffuser vane, diffuser vanes can be generalized, and thus cost reduction of a pump to be manufactured can be achieved.

EXPLANATIONS OF LETTERS OR NUMERALS

Figure 1:
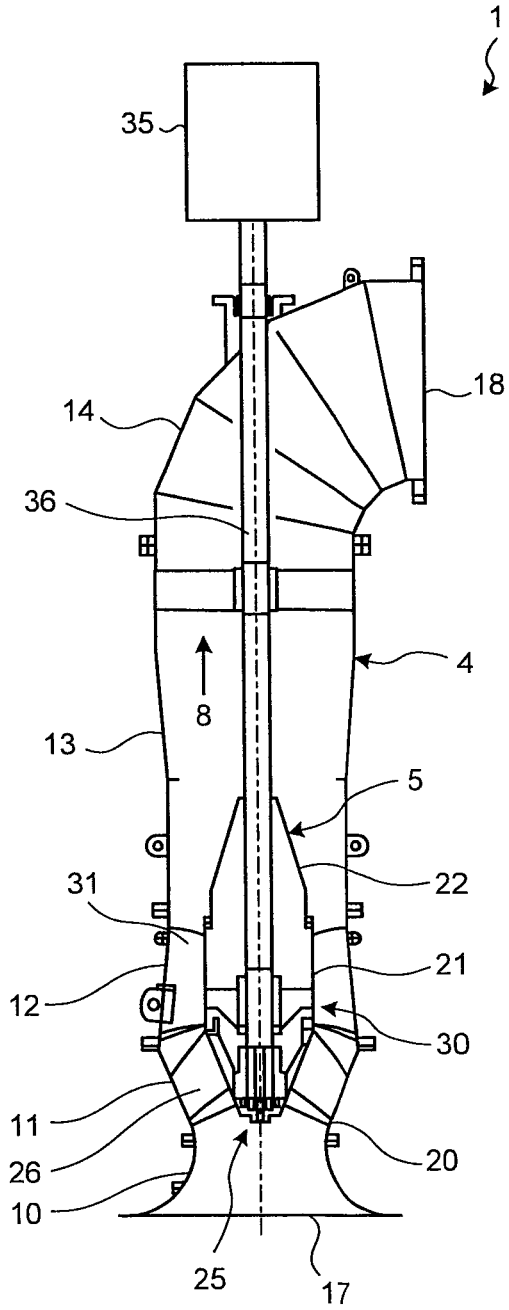
FIG. 1 is a cross-sectional configuration diagram of a mixed-flow pump according to an embodiment of the present invention.

1 mixed-flow pump
4 outer cylinder casing
5 inner cylinder hub
8 flow passage
10 suction bell mouth
11 impeller casing
12 shroud
13 lifting pipe
14 bent pipe
17 suction port
18 discharge port
20 impeller side hub
21 diffuser side hub
22 lifting pipe side hub
25 impeller
26 impeller vanes
30 diffuser
31 diffuser vanes
35 drive source
36 main shaft
40 sheet metal member
41 metal plate
42 plan development view
β average inlet angle

BEST MODE(S) FOR CARRYING OUT THE INVENTION

Exemplary embodiments of a pump to be manufactured by a method of setting a performance characteristic of a pump according to the present invention will be explained below with reference to the accompanying drawings. The present invention is not limited to the following embodiments.

Embodiments

A pump according to an embodiment of the present invention is a so-called vertical diffuser mixed-flow pump (hereinafter, "mixed-flow pump"), and the mixed-flow pump sends out, toward a discharge port, fluid (such as city water) sucked from a suction port by rotating an impeller.

Figure 2:
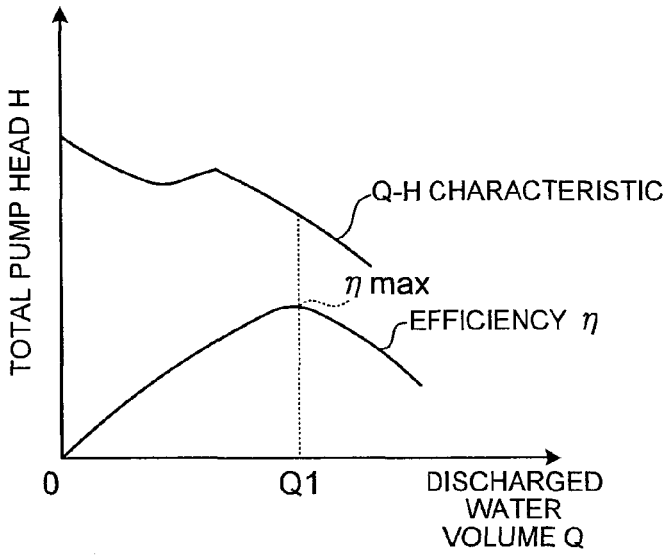
FIG. 2 depicts a Q-H characteristic curve of the mixed-flow pump.
Figure 3:
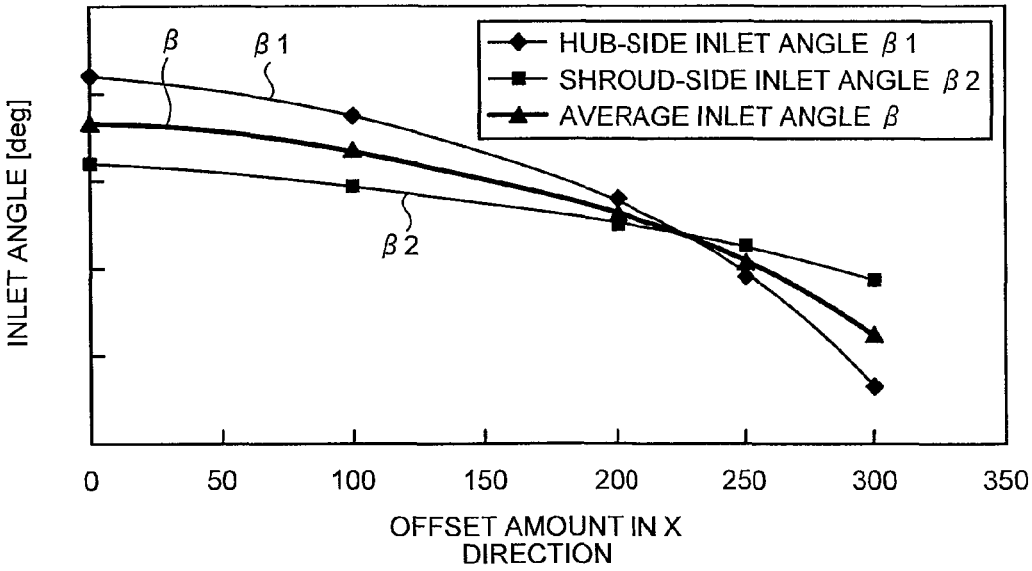
FIG. 3 is a graph of a changing rate of an offset amount that is changed according to a set average inlet angle.
Figure 4:
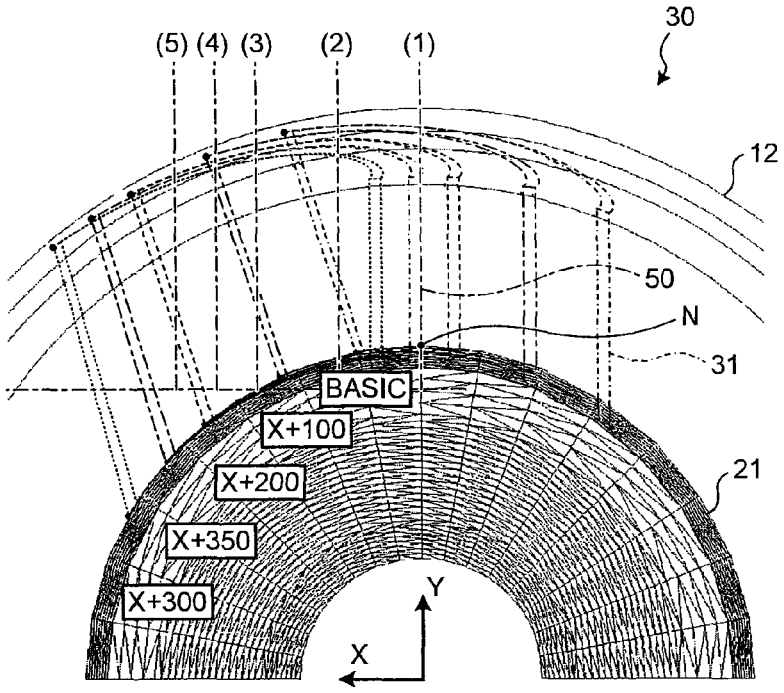
FIG. 4 is an explanatory diagram of mounting positions of diffuser vanes.
Figure 5:
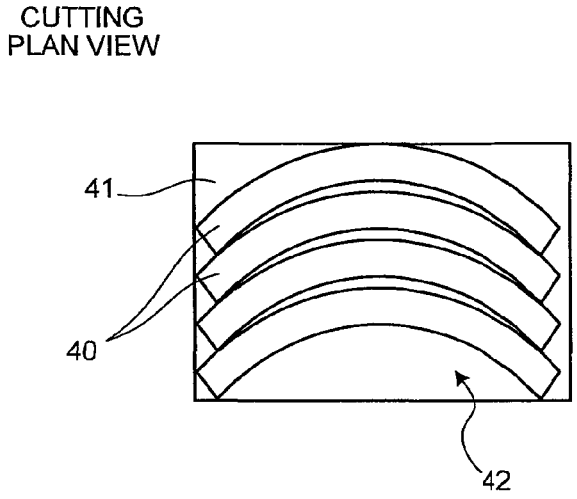
FIG. 5 is a cutting plan view of diffuser vanes.
Figure 6:
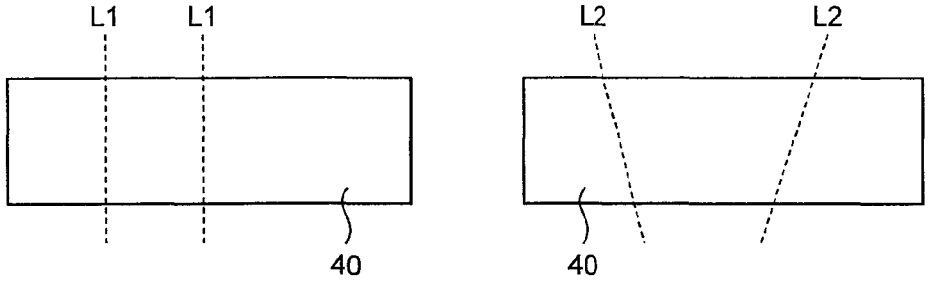
FIG. 6 is an explanatory diagram of a sheet metal member that is bent at a bending step.

FIG. 1 is a cross-sectional configuration diagram of the mixed-flow pump according to the present embodiment, and FIG. 2 depicts a Q-H characteristic curve of the mixed-flow pump. FIG. 3 is a graph of a changing rate of an offset amount that is changed according to a set average inlet angle, and FIG. 4 is an explanatory diagram of mounting positions of diffuser vanes. FIG. 5 is a cutting plan view of the diffuser vanes, and FIG. 6 is an explanatory diagram of a sheet metal member that is bent at a bending step. A configuration of the mixed-flow pump is described below with reference to FIG. 1.

As shown in FIG. 1, a mixed-flow pump 1 includes an outer cylinder casing 4 constituting a hull of the pump, and an inner cylinder hub 5 provided in a central portion of the outer cylinder casing 4. The inner cylinder hub 5 is connected and fixed to the outer cylinder casing 4 through a stay (not shown). A flow passage 8 through which fluid flows is formed between the outer cylinder casing 4 and the inner cylinder hub 5. At this time, fluid flows from the most-upstream side (bottom side in FIG. 1) toward the most-downstream side (top side in FIG. 1).

The outer cylinder casing 4 includes a suction bell mouth 10, an impeller casing 11 connected to an upper portion of the suction bell mouth 10, a shroud 12 connected to an upper portion of the impeller casing 11, a lifting pipe 13 connected to an upper portion of the shroud 12, and a bent pipe 14 connected to an upper portion of the lifting pipe 13, in this order from the lower end side of the outer cylinder casing 4.

The suction bell mouth 10 is formed into a bell mouth shape. A suction port 17 is formed in a lower end surface of the suction bell mouth 10, and a flange that is connected to the impeller casing 11 is formed on an upper end of the suction bell mouth 10.

The impeller casing 11 is formed into an inversed-frustum-cone shape. A flange that is connected to the suction bell mouth 10 is formed on a lower end of the impeller casing 11, and a flange that is connected to the shroud 12 is formed on an upper end of the impeller casing 11.

The shroud 12 is formed into a substantially cylindrical shape. A flange that is connected to the impeller casing 11 is formed on a lower end of the shroud 12, and a flange that is connected to the lifting pipe 13 is formed on an upper end of the shroud 12. The shroud 12 forms a portion of a diffuser 30, and details thereof are described later.

The lifting pipe 13 is formed into a substantially cylindrical shape. A flange that is connected to the shroud 12 is formed on a lower end of the lifting pipe 13, and a flange that is connected to the bent pipe 14 is formed on an upper end of the lifting pipe 13.

The bent pipe 14 is formed into a cylindrical shape that is bent in an arc form so that fluid that is pumped in the vertical direction is guided into the horizontal direction. A discharge port 18 is formed in a side end surface of the bent pipe 14. A flange that is connected to the lifting pipe 13 is formed on a lower end of the bent pipe 14.

The suction bell mouth 10, the impeller casing 11, the shroud 12, the lifting pipe 13, and the bent pipe 14 are fastened to one another through the respective flanges by bolts, thereby constituting the outer cylinder casing 4.

The inner cylinder hub 5 includes an impeller side hub 20, a diffuser side hub 21 arranged above the impeller side hub 20, and a lifting pipe side hub 22 arranged above the diffuser side hub 21, in this order from a lower side of the inner cylinder hub 5.

The impeller side hub 20 is arranged in a central portion of the impeller casing 11, and is formed into a cone-shape that is tapered toward the suction bell mouth 10. The impeller side hub 20 constitutes a portion of an impeller 25. That is, the impeller 25 includes the impeller side hub 20 and a plurality of impeller vanes 26 mounted on an outer periphery of the impeller side hub 20. The impeller 25 is accommodated in the impeller casing 11. The impeller vanes 26 are arranged on the impeller side hub 20 at equal distances from one another in a circumferential direction thereof. The impeller side hub 20 is fixed to a tip end of a later-described main shaft 36. With this configuration, the impeller 25 can rotate as the main shaft 36 rotates.

The diffuser side hub 21 is arranged in a central portion of the shroud 12, and is formed into a cylindrical shape. The diffuser side hub 21 constitutes a portion of the diffuser 30. That is, the diffuser 30 includes the shroud 12 constituting a portion of the flow passage 8, the diffuser side hub 21 arranged in the central portion of the shroud 12, and a plurality of diffuser vanes 31 arranged radially toward an inner peripheral surface of the shroud 12 from an outer peripheral surface of the diffuser side hub 21. The diffuser 30 converts a dynamic pressure of fluid that is sent out from the impeller 25 into a static pressure. Base ends of the diffuser vanes 31 are mounted on the diffuser side hub 21, tip ends of the diffuser vanes 31 are mounted on the shroud 12, and the diffuser vanes 31 are arranged in the circumferential direction at equal distances from one another. Because the diffuser side hub 21 is fixed to the shroud 12 through the diffuser vanes 31, a lower end of the diffuser side hub 21 (on the side of the impeller side hub) permits rotation of the impeller 25. A mounting position of each of the diffuser vanes 31 mounted on the diffuser side hub 21 is appropriately changed according to a performance characteristic of the mixed-flow pump 1. Details of the diffuser vanes 31 are described later.

The lifting pipe side hub 22 is arranged in a central portion of a lower side of the lifting pipe 13. The lifting pipe side hub 22 is tapered toward the bent pipe 14. A lower end of the lifting pipe side hub 22 is connected and fixed to an upper end of the diffuser side hub 21.

The mixed-flow pump 1 includes a drive source 35 arranged above the bent pipe 14, and the main shaft 36 arranged between the drive source 35 and the impeller 25. A motor is used as the drive source 35 for example, and the drive source 35 rotates the impeller 25 through the main shaft 36. The main shaft 36 is arranged in a central portion of the outer cylinder casing 4. A base end of the main shaft 36 passes through the bent pipe 14 and is connected to the drive source 35, a tip end of the main shaft 36 passes through the lifting pipe side hub 22 and passes through an inner side of the diffuser side hub 21 and is connected to the impeller side hub 20 (the impeller 25).

A series of pumping operations of the mixed-flow pump 1 is described. If the drive source 35 is driven to rotate the impeller 25 in a state where the suction port 17 and the impeller 25 of the mixed-flow pump 1 are submerged in water, the impeller 25 that rotates sucks fluid from the suction port 17 and sends out the sucked fluid toward the discharge port 18 in the vertical direction. The fluid having a dynamic pressure sent out from the impeller 25 passes through the diffuser 30 and the dynamic pressure of the fluid is turned into a static pressure. The fluid having the static pressure passes through the lifting pipe 13 and the bent pipe 14 and is discharged from the discharge port 18 in the horizontal direction.

It is necessary to appropriately set the performance characteristic of the mixed-flow pump 1 according to the installing location or the use for the pump, so that the pump can be operated efficiently. That is, when the performance characteristic of the mixed-flow pump 1 is appropriately set, the pumping operations of the mixed-flow pump 1 can be performed efficiently according to the installing location or its use. The performance characteristic of the mixed-flow pump 1 is an efficiency $\eta$ of the mixed-flow pump 1, and the performance characteristic of the mixed-flow pump 1 is set by setting the efficiency $\eta$.

At this time, the efficiency $\eta$ of the mixed-flow pump 1 is set based on an inlet angle of each of the diffuser vanes 31 of the diffuser 30. The inlet angle of the diffuser vanes 31 is described below. The inlet angle of each diffuser vane is an average inlet angle $\beta$ (see FIG. 3) of a hub-side inlet angle $\beta 1$ formed between an outer periphery of the diffuser side hub 21 and a base end of the diffuser vane 31 on the side of the impeller 25 (inlet side) of the diffuser 30 and a shroud-side inlet angle $\beta 2$ formed between an inner periphery of the shroud 12 and a tip end of the diffuser vane 31. By setting this average inlet angle $\beta$, it becomes possible to set the performance characteristic of the mixed-flow pump 1.

However, if a bending curvature of the diffuser vane 31 is changed to set the average inlet angle $\beta$ of the diffuser vane 31, although the performance characteristic of the mixed-flow pump 1 can be set, there is concern that the performance of the mixed-flow pump 1 itself is deteriorated because the bending curvature of the diffuser vane 31 is largely changed. Therefore, in the present embodiment, the mounting position of the diffuser vane 31 is set to a desired mounting position. With this configuration, the average inlet angle $\beta$ of the diffuser vanes 31 is set and with this configuration, a desired performance characteristic of the mixed-flow pump 1 is set without largely changing the bending curvature of the diffuser vane 31. A method of setting the performance characteristic for changing the performance characteristic of the mixed-flow pump 1 is described concretely with reference to FIGS. 2 to 4.

The method of setting the performance characteristic of the mixed-flow pump 1 includes an efficiency setting step of setting the desired efficiency $\eta$ of the mixed-flow pump 1, an inlet-angle setting step of setting the average inlet angle $\beta$ of the diffuser vane 31 corresponding to the set efficiency $\eta$, and a mounting-position setting step of setting a mounting position of the diffuser vane 31 corresponding to the set average inlet angle $\beta$.

At the efficiency setting step, the efficiency $\eta$ of the mixed-flow pump 1 is set such that the efficiency becomes equal to a maximum efficiency $\eta_{max}$ based on a designed discharged water volume Q1 that is set according to the installing location or the use for the mixed-flow pump 1 from the Q-H characteristic curve shown in FIG. 2.

At the inlet-angle setting step, the average inlet angle $\beta$ corresponding to the set efficiency $\eta$ of the mixed-flow pump 1 is derived from a graph (not shown) of the average inlet angle $\beta$ corresponding to the efficiency $\eta$ obtained by an experiment or the like in advance.

At the mounting-position setting step, a mounting position of each of the diffuser vanes 31 mounted on the diffuser side hub 21 is set based on the derived average inlet angle $\beta$ in a perpendicular direction (an X direction) that is perpendicular to a radial direction (a Y direction) of the diffuser side hub 21 and that is in parallel to a tangent direction of a hub outer periphery (see FIG. 4).

As shown in FIG. 4, the Y direction is determined with reference to a radially-intermediate portion 50 of the diffuser vane 31 mounted on a basic mounting position. That is, a radial direction that passes through an intersection N between a base end of the radially-intermediate portion 50 of the diffuser vane 31 and an outer periphery of the diffuser side hub 21 is determined as the Y direction. The X direction is the tangent direction to the outer periphery of the diffuser side hub 21 in the intersection N, and the X direction is perpendicular to the Y direction. That is, the perpendicular direction and the tangent direction are parallel to each other. In a basic design of the mixed-flow pump 1, the basic mounting position ((1) in FIG. 4) is a mounting reference position of the diffuser vane 31 mounted on the diffuser side hub 21.

With reference to FIGS. 3 and 4, a case that one of the diffuser vanes 31 is mounted on the diffuser side hub 21 is specifically described. First, the average inlet angle β is derived at the inlet-angle setting step based on the efficiency η set at the efficiency setting step. Next, an offset amount with respect to a preset basic mounting position is set from a graph of offset amounts corresponding to the average inlet angle β shown in FIG. 3 based on the derived average inlet angle β. To reduce the average inlet angle β, the offset amount is increased. To increase the average inlet angle β, the offset amount is reduced.

If the offset amount is set at the mounting-position setting step as shown in FIG. 4, the diffuser vane 31 is deviated from the basic mounting position in the X direction by the set offset amount while keeping its attitude, and the mounting position of the diffuser vane 31 is set.

When the offset amount is zero, for example, that is, when the mounting position is the basic mounting position, the diffuser vane 31 is mounted on the diffuser side hub 21 at the position (1) in FIG. 4. When the offset amount is 100, the diffuser vane 31 is mounted on the diffuser side hub 21 at a position (2) in FIG. 4. When the offset amount is 200, the diffuser vane 31 is mounted on the diffuser side hub 21 at a position (3) in FIG. 4. When the offset amount is 250, the diffuser vane 31 is mounted on the diffuser side hub 21 at a position (4) in FIG. 4. When the offset amount is 300, the diffuser vane 31 is mounted on the diffuser side hub 21 at a position (5) in FIG. 4. According to this configuration, the average inlet angle β can be set by changing the mounting position without changing the bending curvature of the diffuser vane 31.

Accordingly, the performance characteristic of the mixed-flow pump 1 can be set to the desired efficiency η by mounting the diffuser vanes 31 on the mounting positions after offset. Next, a method of manufacturing the diffuser vane 31 that is manufactured based on the set mounting position is described with reference to FIG. 5.

The method of manufacturing the diffuser vane 31 includes a die-cutting step of die-cutting a sheet metal member 40 that is a material of the diffuser vanes 31 from a metal plate 41 based on the set offset amount, and a bending step of bending the die-cut sheet metal member 40 to form the diffuser vanes 31.

At the die-cutting step, a plan development view 42 of the diffuser vanes 31 is formed from dimensions of various portions of the diffuser vanes 31 manufactured based on the set offset amount. A blank layout diagram as shown in FIG. 5 is formed based on the plan development view 42 of the formed diffuser vanes 31, and the sheet metal members 40 are die-cut from the metal plate 41 based on the formed blank layout diagram.

At the bending step, the die-cut sheet metal member 40 is bent to form the diffuser vanes 31. At this time, as shown in FIG. 6, the diffuser vanes 31 can be formed in two-dimensional bending of bending the sheet metal member 40 along two parallel folding lines L1 and L1, or the diffuser vanes 31 can be formed in three-dimensional bending of bending the sheet metal member 40 along two non-parallel folding lines L2 and L2.

According to the above configuration, it is possible to easily set the performance characteristic of the mixed-flow pump 1 by appropriately setting a mounting position of the diffuser vane 31 to be mounted on the diffuser side hub 21 according to the efficiency η of the mixed-flow pump 1. At this time, only the mounting position of the diffuser vane 31 is changed and the bending curvature of the diffuser vane 31 is not largely changed. Therefore, deterioration in the pump performance caused by a change in shape of the diffuser vane 31 can be suppressed.

With this configuration, the performance characteristic of the mixed-flow pump 1 can be set by the simple method, that is, by setting the mounting position of the diffuser vane 31.

It is only necessary to change the mounting position of the diffuser vane 31 by the offset amount that is set according to the performance characteristic of the mixed-flow pump 1 with reference to the basic mounting position as an index. Therefore, it is possible to easily change the mounting position.

Further, the diffuser vanes 31 suitable for a mounting position after offset can be manufactured by die-cutting the sheet metal member 40 from the metal plate 41 based on the blank layout diagram, and by bending the die-cut sheet metal member 40. According to the method of manufacturing the diffuser vanes 31, the diffuser vanes 31 can be generalized, and thus cost reduction of manufacturing the mixed-flow pump 1 can be achieved.

Although the present embodiment has been described by exemplifying the mixed-flow pump 1, the present invention is not limited to the mixed-flow pump 1, and can be applied to other various pumps such as an axial-flow pump and a centrifugal pump, as far as the pump includes the diffuser 30.

The invention claimed is:

1. A method of setting a performance characteristic of a pump, the pump including an impeller that takes in fluid from a suction port and that sends out the fluid toward a discharge port, and a diffuser provided in a flow passage between the impeller and the discharge port, the method comprising:

providing the diffuser with a hub arranged in a central portion of the flow passage, a shroud arranged around the hub, and a plurality of diffuser vanes radially arranged from an outer peripheral surface of the hub toward an inner peripheral surface of the shroud; and setting a mounting position of each of the diffuser vanes to be mounted on the hub according to a performance characteristic of the pump in a direction perpendicular to a radial direction extending from the hub toward the shroud, wherein the setting includes:

setting an efficiency η of the pump such that the efficiency η becomes equal to a maximum efficiency $\eta_{max}$ based on a designed discharged fluid volume Q1;

deriving an average inlet angle β based on the efficiency η;

setting an offset amount with respect to a preset basic mounting position from an offset amount corresponding to the average inlet angle β based on the average inlet angle β, and setting the mounting position of the diffuser vane to be deviated from the basic mounting position in an X direction by the offset amount, where the X direction is a tangent direction to an outer peripheral surface of the hub at an intersection N of a base end of a radially-intermediate portion of the diffuser vane with the outer peripheral surface of the hub.

2. The method according to claim 1, wherein the basic mounting position is a mounting reference position of the diffuser vane on the hub.

3. The method according to claim 1, wherein the diffuser vane is mounted to be deviated from the basic mounting position in the X direction by the offset amount, while keeping an attitude.

* * * * *